US009879370B2

(12) United States Patent
Jung et al.

(10) Patent No.: US 9,879,370 B2
(45) Date of Patent: Jan. 30, 2018

(54) LAUNDRY TREATING APPARATUS

(71) Applicant: LG ELECTRONICS INC., Seoul (KR)

(72) Inventors: Sungwoon Jung, Seoul (KR); Sungook Bae, Seoul (KR)

(73) Assignee: LG Electronics Inc., Seoul (KR)

( * ) Notice: Subject to any disclaimer, the term of this patent is extended or adjusted under 35 U.S.C. 154(b) by 476 days.

(21) Appl. No.: 14/526,776

(22) Filed: Oct. 29, 2014

(65) Prior Publication Data

US 2015/0114047 A1 Apr. 30, 2015

(30) Foreign Application Priority Data

Oct. 30, 2013 (KR) ..... 10-2013-0129762

(51) Int. Cl.
*D06F 39/02* (2006.01)
*D06F 39/08* (2006.01)

(52) U.S. Cl.
CPC ..... *D06F 39/028* (2013.01); *D06F 39/022* (2013.01); *D06F 39/088* (2013.01)

(58) Field of Classification Search
CPC ..... D06F 39/028
See application file for complete search history.

(56) References Cited

U.S. PATENT DOCUMENTS

2010/0000578 A1 1/2010 Hendrickson et al.
2010/0186461 A1* 7/2010 Hasse ..... D06F 39/022 68/17 R

FOREIGN PATENT DOCUMENTS

CN 1536154 10/2004
CN 200971438 11/2007
CN 101148815 3/2008
EP 2554738 A1 2/2013

OTHER PUBLICATIONS

Office Action issued in Chinese Application No. 201410598281.5 dated Apr. 6, 2016, 9 pages (with English translation).
European Search Report dated Jan. 5, 2015 from European Application No. 14191116.4, 5 pages.

* cited by examiner

*Primary Examiner* — Michael Barr
*Assistant Examiner* — Jason Riggleman
(74) *Attorney, Agent, or Firm* — Fish & Richardson P.C.

(57) ABSTRACT

A laundry treating apparatus includes a cabinet, a laundry receiving part provided within the cabinet and configured to receive laundry, a water supply part configured to supply wash water, and a detergent supplier configured to supply detergent. The detergent supplier includes a storage body having a first storage part configured to hold a first detergent and a second storage part configured to hold a second detergent. The first storage part is configured to communicate with the laundry receiving part, and the second detergent is in liquid form. The detergent supplier further includes a passage body having a water supply passage that is configured to supply the first storage part with the wash water from the water supply part, and a liquid detergent supply part that is configured to supply the water supply passage with the second detergent from the second storage part.

20 Claims, 6 Drawing Sheets

【Fig 1】
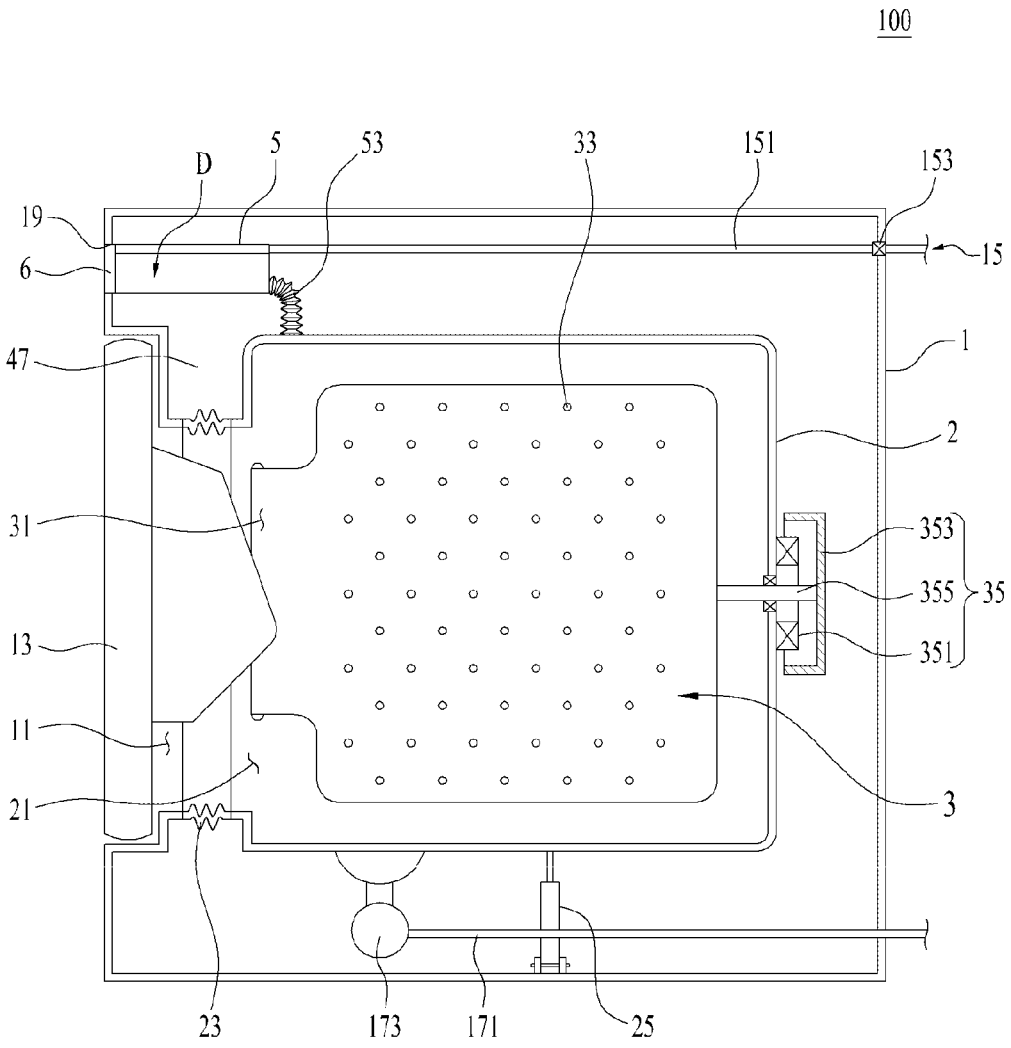

【Fig 2】
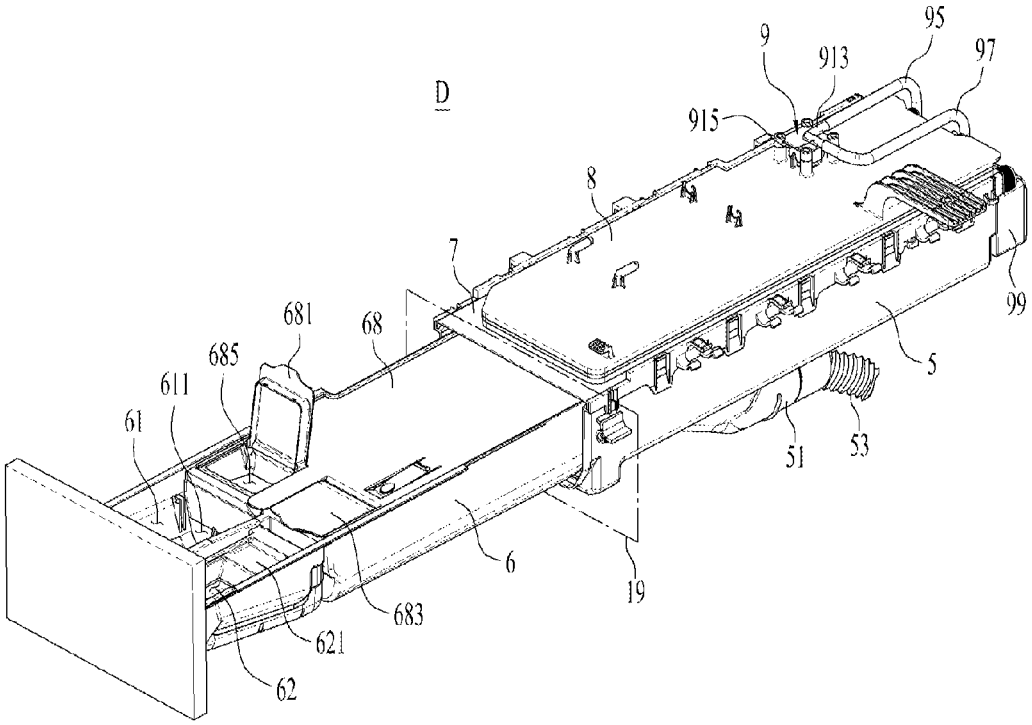

【Fig 3】
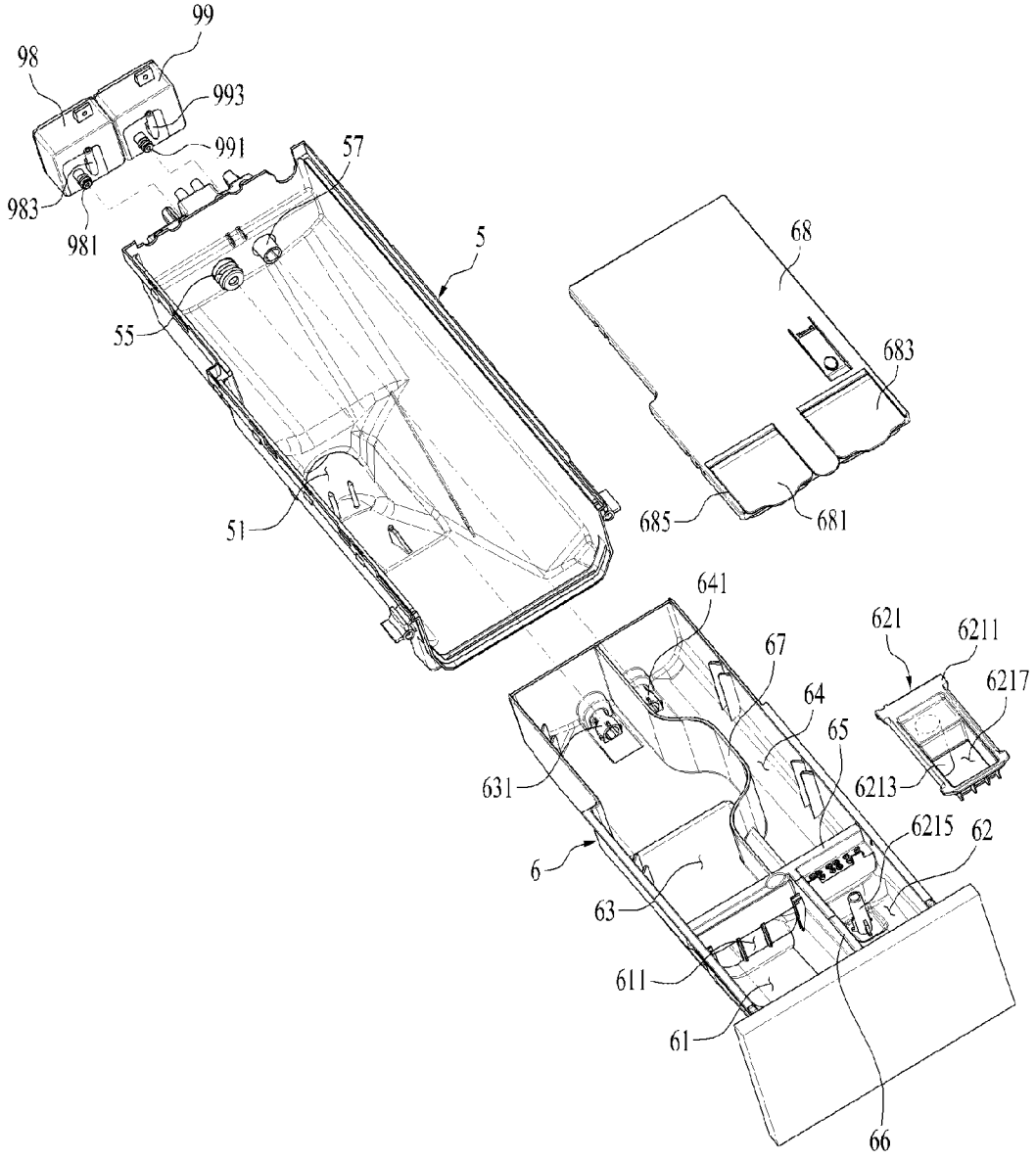

【Fig 4】
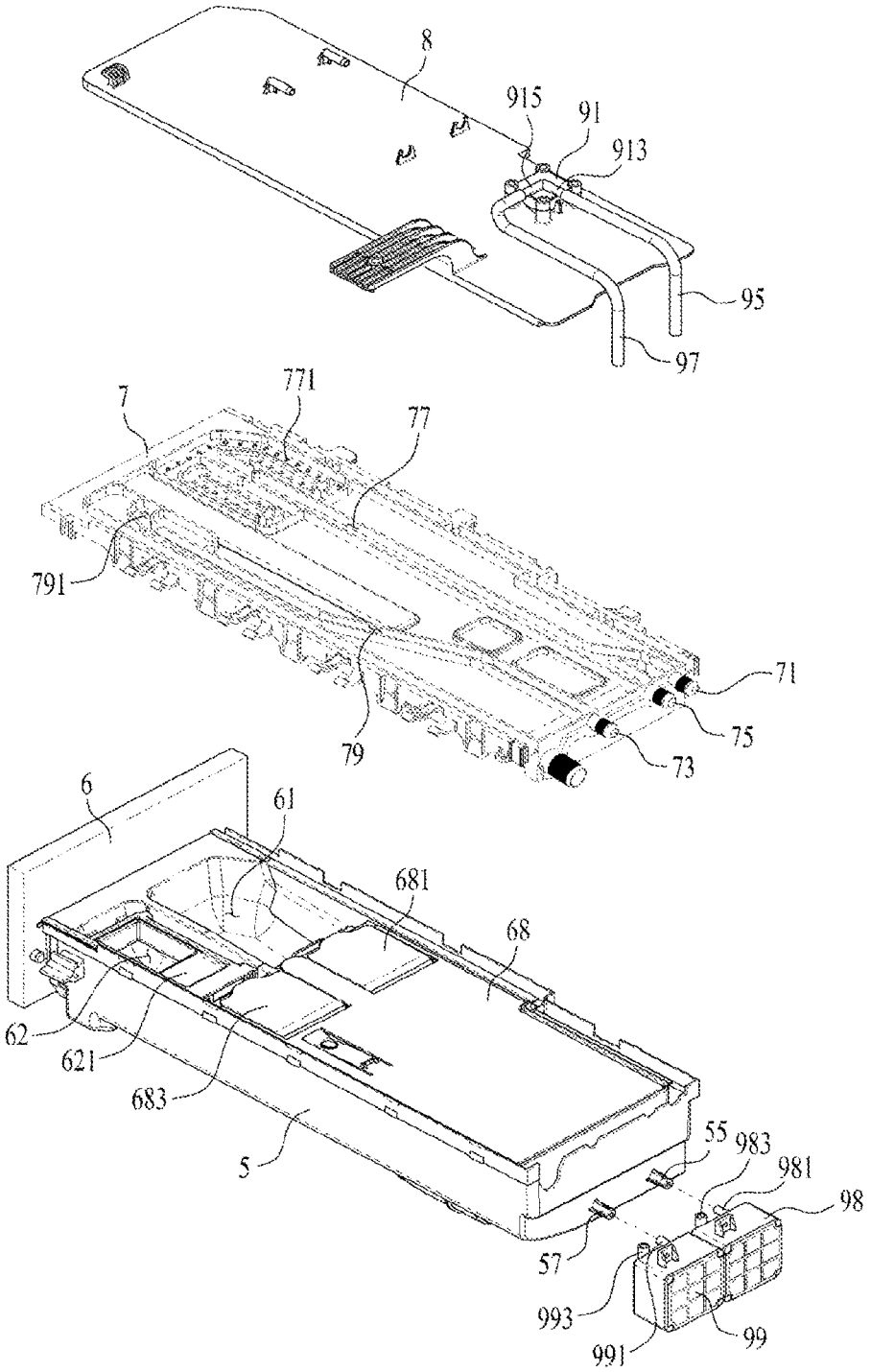

【Fig 5】
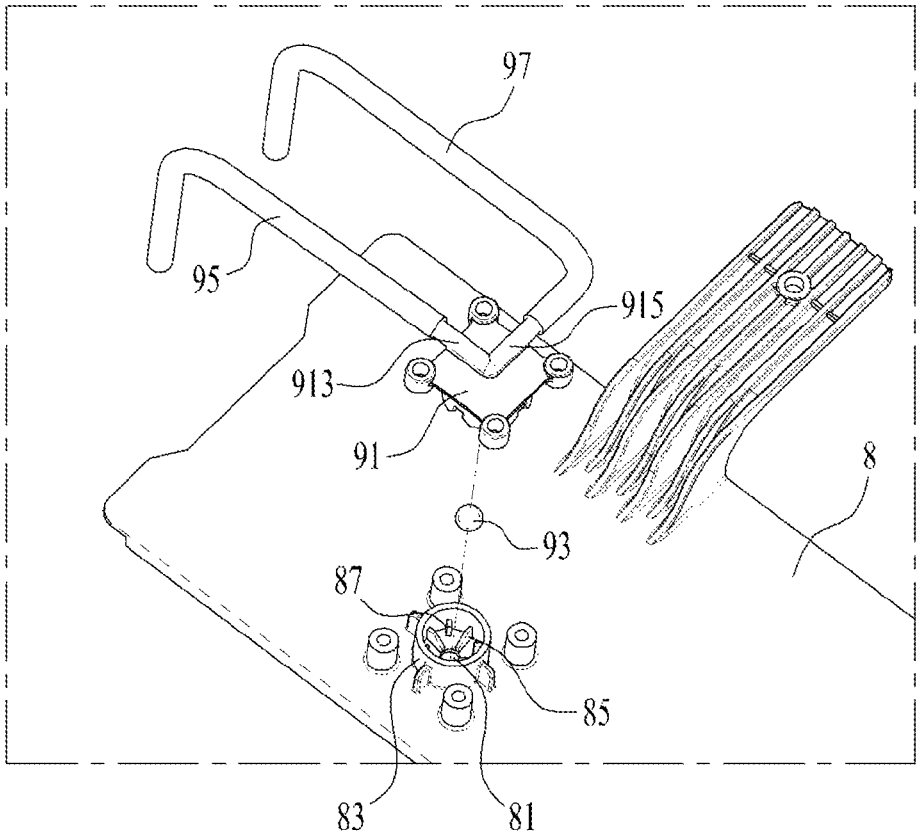

【Fig 6】
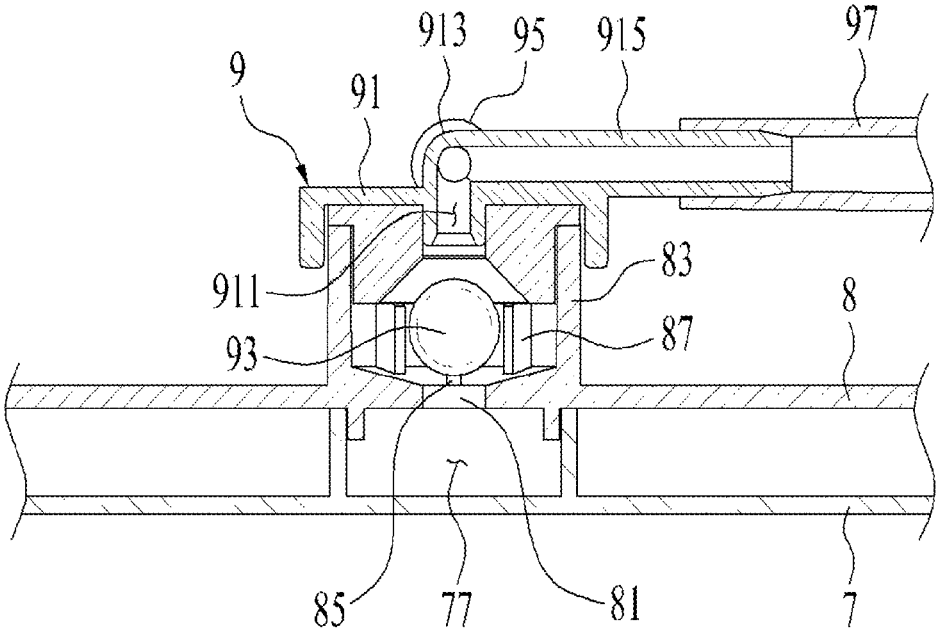

LAUNDRY TREATING APPARATUS

CROSS-REFERENCE TO RELATED APPLICATION

Pursuant to 35 U.S.C. §119(a), this application claims the benefit of earlier filing date and right of priority to Korean Application No. 10-2013-0129762, filed on Oct. 30, 2013, the contents of which are hereby incorporated by reference herein in their entirety.

TECHNICAL FIELD

The present application relates to a laundry treating apparatus, and more particularly, to a laundry treating apparatus equipped with a detergent supplier.

BACKGROUND

Generally, laundry treating apparatuses can include a dryer for drying laundry, a washer for washing laundry, and the like. Particularly, since a detergent or the like can be used for washing, the washer may be equipped with a detergent supplier.

A detergent supplier can have a multitude of detergent storage spaces configured to store different kinds of detergents, respectively. The detergent supplier can also have a multitude of flow passages configured to supply the detergents respectively stored in the detergent storage spaces to a tub having the laundry kept therein. In use, a user can input a predetermined amount of detergent to the detergent supplier.

SUMMARY

One object of the present application may be to provide a laundry treating apparatus equipped with a detergent supplier, by which a detergent can be stored for a long term.

Another object of the present application may be to provide a laundry treating apparatus equipped with a detergent supplier, by which a predetermined amount of detergent can be supplied to the laundry.

Yet another object of the present application may be to provide a laundry treating apparatus equipped with a detergent supplier, by which a multitude of detergents can be supplied to the laundry through a common passage.

Yet another further object of the present application may be to provide a laundry treating apparatus equipped with a detergent supplier, by which a detergent can be prevented from remaining in a detergent storage space as small as it can.

Technical tasks obtainable from the present application are non-limited by the above-mentioned technical tasks. And, other unmentioned technical tasks may be clearly understood from the following description by those having ordinary skill in the technical field to which the present application pertains.

Additional advantages, objects, and features of the application will be set forth in part in the description which follows and in part will become apparent to those having ordinary skill in the art upon examination of the following or may be learned from practice of the application. The objectives and other advantages of the application may be realized and attained by the structure particularly pointed out in the written description and claims hereof as well as the appended drawings.

According to one aspect, a laundry treating apparatus includes a cabinet, a laundry receiving part provided within the cabinet and configured to receive laundry, a water supply part configured to supply wash water, and a detergent supplier configured to supply detergent. The detergent supplier includes a storage body having a first storage part configured to hold a first detergent and a second storage part configured to hold a second detergent. The first storage part is configured to communicate with the laundry receiving part, and the second detergent is in liquid form. The detergent supplier further includes a passage body having a water supply passage that is configured to supply the first storage part with the wash water from the water supply part, and a liquid detergent supply part that is configured to supply the water supply passage with the second detergent from the second storage part.

Implementations of this aspect may include one or more of the following features. For example, the laundry treating apparatus may further include a cover provided above the passage body. The cover may be configured to seal the water supply passage, and the cover may include a cover perforating hole that perforates the cover. The cover perforating hole may be configured to enable fluidic communication between the water supply passage and the liquid detergent supply part. The liquid detergent supply part may include a valve body, a pump configured to discharge the second detergent in the second storage part from the second storage part, and a supply pipe configured to lead the second detergent discharged from the pump to the body perforating hole. The valve body may include a body perforating hole that enables fluidic communication with the cover perforating hole. The liquid detergent supply part may further include a valve configured to selectively open and close the body perforating hole. The cover may further include a flange that is configured to surround the cover perforating hole and to seat the valve body within the flange. The flange may include one or more ribs that extend inward toward the valve body, and the liquid detergent supply part may further include a ball that is configured to be supported by the one or more ribs. The ball may be configured to allow fluid flow from the body perforating hole into the cover perforating hole and to prevent the wash water from flowing from the cover perforating hole into the body perforating hole. The laundry treating apparatus may further include a control unit configured to alternately control the water supply part and the liquid detergent supply part to supply the wash water and the second detergent, respectively. The laundry treating apparatus may further include a control unit configured to control the water supply part and the liquid detergent supply part to supply the wash water and the second detergent, respectively. The controller unit may be configured to control the water supply part to supply and stop supplying the wash water to the water supply passage. The control unit may be configured to, based on the wash water being stopped, control the liquid detergent supply part to supply the second detergent in the second storage part to the water supply passage. The detergent supplier may further include a support body provided within the cabinet. The support body may be configured to support the storage body and to communicate with the laundry receiving part, wherein the storage body is configured to be removed from the cabinet by being detached from the support body. The support body may further include a connecting pipe configured to communicate externally from the laundry treating apparatus and a discharge hole connected to the laundry receiving part. The storage body may further include a discharge pipe that is configured to discharge the first detergent in the first storage part into the support body and a detachable pipe that is detachably coupled to the connecting pipe to lead the second detergent in the second storage part to the connecting pipe. The liquid detergent supply part may further include a valve body having a body perforating hole configured to communicate with the cover perforating hole, a pump provided to the connecting pipe to discharge the second detergent in the second storage part out of the support body, and a supply pipe configured to lead the second detergent discharged from the pump to the body perforating hole. The cover may further include a flange that is configured to surround the cover perforating hole and to seat the valve body within the flange, the flange including one or more ribs that extend inward toward the valve body. The liquid detergent supply part may further include a ball that is configured to be supported by the one or more ribs, the ball being configured to allow fluid flow from the body perforating hole into the cover perforating hole and to prevent, by blocking the body perforating hole, the wash water from flowing from the cover perforating hole into the body perforating hole. The detergent supplier may further include a cover configured to be coupled to the storage body and to form a top face of the second storage part, the cover defining an opening that perforates the cover, and a lid configured to selectively open and close the opening. The first storage part may be configured to hold the first detergent, wherein the first detergent includes detergent that is in powder form. The first storage part may include first and second spaces that are separated by a first sidewall. The second storage part may include first and second spaces that are separated by a second sidewall.

According to another aspect, a detergent supplier for a laundry treating apparatus includes a storage body having a first storage part configured to hold a first detergent and a second storage part configured to hold a second detergent. The first storage part is configured to communicate with the laundry receiving part, and the second detergent is in liquid form. The detergent supplier further includes a passage body having a water supply passage that is configured to supply the first storage part with the wash water from the water supply part, and a liquid detergent supply part that is configured to supply the water supply passage with the second detergent from the second storage part.

Implementations of this aspect may include one or more of the following features. For example, the detergent supplier may further include a cover provided above the passage body. The cover may be configured to seal the water supply passage. The cover may include a cover perforating hole that perforates the cover, the cover perforating hole being configured to enable fluidic communication between the water supply passage and the liquid detergent supply part. The liquid detergent supply part may include a valve body, the valve body including a body perforating hole that enables fluidic communication with the cover perforating hole, a pump configured to discharge the second detergent in the second storage part from the second storage part, and a supply pipe configured to lead the second detergent discharged from the pump to the body perforating hole. The liquid detergent supply part may further include a valve configured to selectively open and close the body perforating hole. The cover may further include a flange that is configured to surround the cover perforating hole and to seat the valve body within the flange. The flange may include one or more ribs that extend inward toward the valve body. The liquid detergent supply part may further include a ball that is configured to be supported by the one or more ribs. The ball may be configured to allow fluid flow from the body perforating hole into the cover perforating hole and to prevent the wash water from flowing from the cover perforating hole into the body perforating hole. The first storage part may be configured to hold the first detergent. The first detergent may include detergent that is in powder form. The first storage part may include first and second spaces that are separated by a first sidewall. The second storage part may include first and second spaces that are separated by a second sidewall.

The details of one or more implementations described in this specification are set forth in the accompanying drawings and the description below. Other potential features and aspects of the present application will become apparent from the descriptions, the drawings and the claims.

BRIEF DESCRIPTION OF THE DRAWINGS

FIG. 1 is a schematic cross-sectional diagram illustrating an example of a laundry treating apparatus according to the present application.

FIG. 2 is a perspective diagram illustrating an example of a detergent supplier provided to a laundry treating apparatus according to the present application.

FIG. 3 is an exploded perspective diagram illustrating an example support body and a storage body provided to the detergent supplier.

FIG. 4 is an exploded perspective diagram illustrating the example detergent supplier.

FIG. 5 is an exploded perspective diagram illustrating an example liquid detergent supply part provided to the detergent supplier.

FIG. 6 is a cross-sectional diagram illustrating the example liquid detergent supply part.

DETAILED DESCRIPTION

The implementations disclosed in this disclosure and configurations shown in the accompanying drawings are example implementations and do not represent all technical ideas of the present application. Therefore, it is understood that the present application covers modifications and variations of this application that come within the scope of the appended claims and their equivalents. Wherever possible, the same reference numbers will be used throughout the drawings to refer to the same or similar parts.

Referring to FIG. 1, a laundry treating apparatus 100 according to the present application includes a cabinet 1 forming an exterior, a laundry receiving part provided in the cabinet 1 to store laundry therein, and a detergent supplier D configured to store a detergent and supply the stored detergent to the laundry receiving part.

The cabinet 1 includes an entrance 11 for putting in or taking out the laundry stored in the laundry receiving part 2 and 3. The entrance 11 can be opened/closed by a door 13. The laundry receiving part includes a tub 2 provided within the cabinet 1 to store wash water therein and a drum 3 provided within the tub 2 to store the laundry.

The tub 2 includes a tub entrance 21 communicating with the entrance 11 and is fixed to an inside of the cabinet 1 through a tub support 25. Between the tub entrance 21 and the entrance 11, a gasket 23 may be provided to prevent the stored wash water from leaking.

The drum 3 may be configured with a cylindrical shape and can rotate within the tub 2. The drum 3 may include a drum entrance 31 communicating with the tub entrance 21 and a multitude of perforated holes 33 through which the inside of the drum 3 can communicate with the tub 2. The drum 3 is rotated by a motor 35 provided to a backside of the tub 2. In some cases, the motor 35 may include a stator 352 fixed to the backside of the tub 2, a rotor 353 rotated by a rotational magnetic field provided by the stator 351, and a rotational shaft 355 configured to connect the drum 3 and the rotor 353 to each other by perforating the backside of the tub 2.

The tub 2 is supplied with the wash water through a water supply part. The wash water stored in the tub 2 can be drained out of the cabinet 1 through a drainage part. The drainage part may include a drainage pipe 171 leading the wash water in the tub 2 to an outside of the cabinet 1 and a drainage pump 173 provided to the drainage pipe 171. The water supply part may include a water supply pipe 151 configured to supply the wash water to the detergent supplier D from a water supply source located outside the cabinet 1 and a water supply valve configured to open/close the water supply pipe 151.

Referring to FIG. 2, the detergent supplier D may include a support body 5 fixed to the cabinet 1, a storage body 6 supported by the support body 5 by having at least two storage parts configured to store detergents therein, a passage body 7 having a water supply passage for supplying the water supplied through the water supply pipe 151 to one of the at least two storage parts, and a liquid detergent supply part 9 configured to supply the detergent stored in the other storage part to the water supply passage.

The detergent supplier D of the present invention may be configured to store at least two kinds of detergents; however, as further detailed below, the number of the passages for supplying detergents to the tub may be less than the number of the kinds of detergents. This is because the detergent stored in one of the two storage parts can be supplied to the tub through a passage for supplying the detergent stored in the other of the two storage parts to the tub.

Referring to FIG. 3, the support body 5 may be configured in a hexahedral shape of which top and front faces are open. As illustrated, a discharge hole 51 is provided to a bottom face of the support body 5. The discharge hole 51 can be connected to the tub 2 through a tub supply pipe 53 (see FIG. 2).

The storage body 6 may be configured in a hexahedral shape of which top face is open. In particular, the storage body 6 may include a first storage part configured to provide a space for storing a detergent and a second storage part configured to provide a space for storing a detergent.

The storage body 6 may be inserted in the support body 5 through the open front face of the support body 5. The storage body 6 inserted in the support body 5 may be detached from the support body 5 and then pulled out of the cabinet 1 through a cabinet perforated hole 19 provided to the cabinet 1.

The first storage part provided to the support body 5 may include a first detergent storage part 61 (i.e., a powder detergent storage part) and a second detergent storage part 62 (i.e., a fabric softener storage part) or may include the first detergent storage part 61 only. The second storage part can be a space for storing liquid detergents. For example, the second storage part may include a first liquid detergent storage part 63 and a second liquid detergent storage part 64 or may include the first liquid detergent storage part 63 only.

The first storage part 61 and 62 and the second storage part 63 and 64 may be separated from each other by a first sidewall 65 provided along a width direction of the storage body 6. The first detergent storage part 61 and the second detergent storage part 62 may be separated from each other by a second sidewall 66 provided along a length direction of the storage body 6. The first liquid detergent storage part 63 and the second liquid detergent storage part 64 may be separated from each other by a third sidewall 67 provided from the first sidewall 65 along the length direction of the storage body 6.

If the storage body 6 has the above-mentioned configuration, the detergent supplier D of the present application can store four different kinds of detergents separately. Moreover, the four different kinds of the detergents can be stored without being mixed together.

For example, the first detergent storage part 61 communicates with the support body 5 through a first discharge part 611. And the second detergent storage part 62 communicates with the support body 5 through a second discharge part 621. Hence, the detergent stored in the first detergent storage part 61 can be transferred to the support body 5 through the first discharge part 611. Subsequently, the detergent transferred to the support body 5 can be transferred to the tub 2 through the discharge hole 51 and the tub supply pipe 53.

The detergent stored in the second detergent storage part 62 can be transferred to the tub 2 through a second discharge part 621, the discharge hole 51 and the tub supply pipe 53. In particular, the second discharge part 621 can be configured to discharge a detergent to the support body 5 by a siphon phenomenon. To this end, the second detergent storage part 62 can include a structure of a discharge pipe 6215 configured in a manner of projecting from a floor surface toward a discharge body.

The second detergent discharge part 621 may include a discharge body 6211 fixed to a top face of the second detergent storage part 62 and a receiving part 6213 extended from the discharge body 6211 toward the discharge pipe 6215 to receive an outer circumference of the discharge pipe 6215. In this case, a space is formed between the outer circumference of the discharge pipe and an inner circumference of the receiving pipe 6213 so that fluid can be transferred through the space.

Hence, if a water is supplied to the second detergent storage part 62 through an inlet 6217 provided to the discharge body 6211, the detergent and water stored in the second detergent storage part 62 are not discharged to the support body 5 until a water level in the second detergent storage part 62 reaches a height of the discharge pipe 6215.

On the contrary, if a water level in the second detergent storage part 62 exceeds the height of the discharge pipe 6215, the whole detergent and water in the second detergent storage part 62 will be transferred to the support body 5 by the siphon phenomenon.

The first liquid detergent storage part 63 can communicate externally through a first detachable pipe 631, while the second liquid detergent storage part 64 can communicate externally through a second detachable pipe 641. Since the storage body 6 of the present application may be configured separable from the support body 5, a connecting pipe detachable from the first detachable pipe 631 and the second detachable pipe 641 in accordance with a location of the storage body 6 may further be provided to the support body 5.

The connecting pipe may include a first connecting pipe 55 and a second connecting pipe 57. Accordingly, the first connecting pipe 55 can be connected to the first detachable pipe 631 if the storage body 6 is inserted in the support body 5, and the second connecting pipe 57 can be connected to the second detachable pipe 641 if the storage body 6 is inserted in the support body 5. Hence, the detergent stored in the first liquid detergent storage part 63 can be externally discharged out of the support body 5 through the first detachable pipe 631 and the first connecting pipe 55, and the detergent stored in the second liquid detergent storage part 64 can be externally discharged out of the support body 5 through the second detachable pipe 641 and the second connecting pipe 57.

The storage body 6 can be further provided with a storage body cover 68 forming a top face of the second storage part 63 and 64. The storage body cover 68 may be provided with two openings 685 respectively communicating with the first liquid detergent storage part 63 and the second liquid detergent storage part 64. The two openings 685 can be opened or closed by a first lid 681 and a second lid 683, respectively.

Accordingly, if the storage body 6 is detached from the support body 5 and then pulled out of the cabinet 1 through the cabinet perforated hole 19, as shown in FIG. 2, the top face of the first storage part 61 and 62 is kept open, but the top face of the second storage part 63 and 64 is kept closed by the storage body cover 68. Hence, after the storage body 6 has been pulled out of the cabinet 1, a user can supply a powder detergent, a fabric softener and the like to the first storage part 61 and 62 and is also able to supply liquid detergents to the second storage part 63 and 64 through the first lid 681 and the second lid 683.

Referring to FIG. 4, a passage body 7 is fixed to an open top face of the support body 5. Additionally, the storage body 6 is located in a space formed by the support body 5 and the passage body 7. A water supply passage is provided to the passage body 7 so as to lead the water supplied through the water supply pipe 151 to the first storage part 61 and 62.

In cases where the first storage part 61 and 62 includes the first detergent storage part 61 and the second detergent storage part 62, the water supply passage can include a first passage 77 configured to lead the water to the first detergent storage part 61 and a second passage 79 configured to lead the water to the second detergent storage part 62.

In order to supply the water to each of the first passage 77 and the second passage 79, the water supply pipe 151 of the present application can include a first water supply pipe connected to the first passage 77 and a second water supply pipe connected to the second passage 79.

In this case, the first water supply pipe is provided to connect a first water supply pipe connecting part 71 to the water supply valve 153, the second water supply pipe is provided to connect a second water supply pipe connecting part 73 to the water supply valve 153, and the first water supply pipe and the second water supply pipe can be opened/closed by the water supply valve 153. In some cases, the water supply valve 153 may include a two-way valve.

Moreover, in cases where the laundry treating apparatus according to the present application 100 is configured to supply hot water to the tub 2, the water supply part can further include a hot water supply valve connected to a water supply source for supplying hot water and a third water supply pipe configured to connect the hot water supply valve and the third water supply pipe connecting part 75 to each other.

In this case, the third water supply pipe connecting part 75 may be configured to be connected to one of the first passage 77 and the second passage 79. The first passage 77 and the second passage 79 are provided to a top face of the passage body 7. In particular, the first passage 77 is configured to face the first detergent storage part 61 from the first water supply pipe connecting part 71, and the second passage 79 is configured to face the second detergent storage part 62 from the second water supply pipe connecting part 73.

In some cases, the first water supply pipe connecting part 71 and the third water supply pipe connecting part 75 are provided to one end of the first passage 77, while a first hole 771 located at the top face of the first detergent storage part 61 is provided to the other end of the first passage 77.

Since the first hole 771 perforates the passage body 7, the water flowing along the first passage 77 can be supplied to the first detergent storage part 61. In some cases, a multitude of first holes 771 provided to the first passage 77 can be provided in a region of the passage body 7 corresponding to the top face of the first detergent storage part 61.

Hence, if the water flowing through the first passage 77 is simultaneously supplied to the whole region of the first detergent storage part 61, it is able to minimize the detergent that remains in the first detergent storage part 61.

In some cases, the first hole 771 can include a first supply part having a multitude of holes provided along an edge of the top face of the first detergent storage part 61 and a second supply part provided within the region for configuring the first supply part.

The second water supply pipe connecting part 73 is provided to one end of the second passage 79 and a second hole 791 located over a top of the second detergent storage part 62 is provided to the other end of the second passage 79. Hence, the water flowing through the second passage 79 is supplied to the second detergent storage part 62 through the inlet 6217 of the second discharge part 621.

Meanwhile, a cover 8 forming the top faces of the first and second passages 77 and 79 are provided to a top of the passage body 7. The cover 8 is provided with a liquid detergent supply part 9 configured to transfer the detergents stored in the second storage part 63 and 64 to the water supply passage 77 and 79.

Referring to FIG. 5, a cover perforating hole 81 is provided to the cover 8. The cover perforating hole 81 may be located over the first passage 77 or the second passage 79. For clarity of the following description, it may be assumed that the cover perforating hole 81 is located over the first passage 77.

As illustrated, a flange 83 projecting from a surface of the cover 8 is provided to a circumference of the cover perforating hole 81, and a rib 85 and 87 projecting from the surface of the cover 8 is provided within the flange 83.

In some cases, the rib 85 and 87 may include a first rib 85 extended from the circumference of the cover perforating hole 81 toward the flange 83 along a diameter direction of the cover perforating hole 81 and a second rib 87 having a length shorter than that of the first rib 85.

The liquid detergent supply part 9, as shown in FIG. 4, may include a valve body 91 fixed to the flange 83, a pump 98 and 99 communicating with the liquid detergent storage part 63 and 64 by being fixed to the support body 5, and a supply pipe 95 and 97 configured to connect the pump and the valve body 91 to each other.

In cases where the second storage part includes the first liquid detergent storage part 63 and the second liquid detergent storage part 64, the pump may include a first pump 98 configured to externally discharge the detergent stored in the first liquid detergent storage part 63 and a second pump 99 configured to externally discharge the detergent stored in the second liquid detergent storage part 64.

The supply pipe may include a first supply pipe 95 configured to connect the first pump 98 and the valve body 91 to each other and a second supply pipe 97 configured to connect the second pump 99 and the valve body 91 to each other.

The first pump 98 may include a pump inlet 981 inserted in the first connecting pipe 55 and a pump outlet 983 connected to the first supply pipe 95. The second pump 99 may include a pump inlet 991 inserted in the second connecting pipe 57 and a pump outlet 993 connected to the second supply pipe 97.

Referring to FIG. 6, the valve body 91 is fixed to the open top face of the flange 83. A body perforating hole 911 configured to enable an inner space of the flange 83 to communicate with an outer environment is provided to the valve body 91.

As illustrated, a first pipe 913 and a second pipe 915 are connected to the body perforating hole 911. In particular, the first supply pipe 95 is connected to the first pipe 913, while the second supply pipe 97 is connected to the second pipe 915. Hence, the detergent discharged from the first liquid detergent storage part 63 through the first pump 98 is supplied to the first passage 77 through the first supply pipe 95, the first pipe 913 and the body perforating hole 911. The detergent discharged from the second liquid detergent storage part 64 through the second pump 99 is supplied to the first passage 77 through the second supply pipe 97, the second pipe 915, and the body perforating hole 911.

In a detergent supplier D configured with the above-described structure, if the water is supplied to the first passage 77, the water in the first passage 77 may flow backward into the body perforating hole 911. To solve this problem, the liquid detergent supply part 9 may be further provided with a valve 93 configured to selectively open the body perforating hole 911.

FIG. 6 shows one example of the valve 93. As illustrated, the valve 93 of the present application may include a ball provided within the flange 83 in a manner of being spaced apart from the cover perforating hole 81 in a prescribed distance by the rib 85 and 87.

Hence, if the water supplied through the first passage 77 enters the flange 83 through the cover perforating hole 81, the ball blocks the body perforating hole 911 so as to prevent the water in the first passage 77 from flowing into the body perforating hole 911.

Since the ball is spaced apart from the cover perforating hole 81 in the prescribed distance by the rib 85 and 87, it can maintain a constant open state. Hence, the liquid detergent supplied to the body perforating hole 911 through the pump 98 and 99 can be transferred to the first passage 77 through the space between the first rib 85 and the second rib 87 and the cover perforating hole 81.

The water supply through the first passage 77 and the liquid detergent supply through the pump 98 and 99 may be performed simultaneously or alternately.

In order to supply the liquid detergent in the course of supplying the water along the first passage 77, the pressure of the liquid detergents supplied by the first pump 98 and the second pump 99 may be necessarily greater than that of an inside of the first passage 77.

If the water supply through the first passage 77 and the liquid detergent supply through the pump 98 and 99 is performed alternately, a control unit can be used to control the water supply valve 153 so that the water can continue to be supplied and stop being supplied to the first passage 77 alternately. When the water is not supplied to the first passage 77, the control unit can activate the pump 98 and 99 to supply the liquid detergent to the first passage 77.

As described above, according to the present application, the liquid detergent stored in the second storage part 63 and 64 can be supplied to the tub 2 using the passage 77 and 79 provided to supply the detergents stored in the first storage part 61 and 62 to the tub 2. Accordingly, a separate passage for supplying the detergents stored in the second storage part 63 and 64 to the passage body 7 and the storage body 6 may not be required.

Moreover, since the liquid detergent supplied to each of the passages 77 and 79 is transferred to the tub 2 together with the water flowing through the corresponding passage, the present application can prevent the liquid detergent from coagulating to block the corresponding passage 77, 79.

The aforementioned implementations are achieved by combination of structural elements and features of the present application in a predetermined type. Each of the structural elements or features should be considered selectively unless specified separately. Each of the structural elements or features may be carried out without being combined with other structural elements or features. Also, some structural elements and/or features may be combined with one another to constitute the implementations of the present application.

It will be apparent to those skilled in the art that various modifications and variations can be made in the present application without departing from the spirit or scope of the application. Thus, it is intended that the present application covers modifications and variations of this application that come within the scope of the appended claims and their equivalents.

What is claimed is:

1. A laundry treating apparatus comprising:

a cabinet;

a laundry receiving part provided within the cabinet and configured to receive laundry;

a water supply part configured to supply wash water; and a detergent supplier configured to supply detergent, the detergent supplier comprising:

a storage body having a first storage part configured to hold a first detergent, the first storage part being configured to communicate with the laundry receiving part, and a second storage part configured to hold a second detergent, wherein the second detergent is in liquid form, a passage body having a water supply passage configured to supply the first storage part with the wash water from the water supply part, and a liquid detergent supply part configured to supply the water supply passage with the second detergent from the second storage part, wherein the liquid detergent supply part comprises:

a pump configured to discharge the second detergent from the second storage part, and a supply pipe configured to supply the second detergent discharged from the pump to the water supply passage.

2. The laundry treating apparatus of claim 1, further comprising:

a cover provided above the passage body, the cover being configured to seal the water supply passage, wherein the cover includes a cover perforating hole that perforates the cover, the cover perforating hole being configured to enable fluidic communication between the water supply passage and the supply pipe.

3. The laundry treating apparatus of claim 2, wherein the liquid detergent supply part further comprises a valve body, the valve body including a body perforating hole that enables fluidic communication with the cover perforating hole, and wherein the supply pipe is configured to lead the second detergent to the body perforating hole.

4. The laundry treating apparatus of claim 3, wherein the liquid detergent supply part further comprises a valve configured to selectively open and close the body perforating hole.

5. The laundry treating apparatus of claim 3, wherein the cover further comprises a flange that is configured to surround the cover perforating hole and to seat the valve body within the flange, the flange including one or more ribs that extend inward toward the valve body, and wherein the liquid detergent supply part further comprises a ball that is configured to be supported by the one or more ribs, the ball being configured to allow fluid flow from the body perforating hole into the cover perforating hole and to prevent the wash water from flowing from the cover perforating hole into the body perforating hole.

6. The laundry treating apparatus of claim 1, further comprising a control unit configured to alternately control the water supply part and the liquid detergent supply part to supply the wash water and the second detergent, respectively.

7. The laundry treating apparatus of claim 1, further comprising a control unit configured to control the water supply part and the liquid detergent supply part to supply the wash water and the second detergent, respectively, wherein the controller unit is configured to control the water supply part to supply and stop supplying the wash water to the water supply passage, and wherein the control unit is configured to, based on the wash water being stopped, control the liquid detergent supply part to supply the second detergent in the second storage part to the water supply passage.

8. The laundry treating apparatus of claim 3, wherein the detergent supplier further comprises a support body provided within the cabinet, the support body being configured to support the storage body and to communicate with the laundry receiving part, wherein the storage body is configured to be removed from the cabinet by being pulled out from the support body through an opening defined by the cabinet.

9. The laundry treating apparatus of claim 8, wherein the support body further comprises:

a connecting pipe configured to communicate externally from the laundry treating apparatus; and a discharge hole connected to the laundry receiving part, wherein the storage body further comprises a discharge pipe that is configured to discharge the first detergent in the first storage part into the support body and a detachable pipe that is detachably coupled to the connecting pipe to lead the second detergent in the second storage part to the connecting pipe, and wherein the pump is connected to the connecting pipe to thereby discharge the second detergent in the second storage part out of the support body.

10. The laundry treating apparatus of claim 9, wherein the cover further comprises a flange that is configured to surround the cover perforating hole and to seat the valve body within the flange, the flange including one or more ribs that extend inward toward the valve body, and wherein the liquid detergent supply part further comprises a ball that is configured to be supported by the one or more ribs, the ball being configured to allow fluid flow from the body perforating hole into the cover perforating hole and to prevent, by blocking the body perforating hole, the wash water from flowing from the cover perforating hole into the body perforating hole.

11. The laundry treating apparatus of claim 9, wherein the detergent supplier further comprises:

a cover configured to be coupled to the storage body and to form a top face of the second storage part, the cover defining an opening that perforates the cover; and a lid configured to selectively open and close the opening.

12. The laundry treating apparatus of claim 1, wherein the first storage part is configured to hold the first detergent, wherein the first detergent includes detergent that is in powder form.

13. The laundry treating apparatus of claim 1, wherein the first storage part includes first and second spaces that are separated by a first sidewall, and wherein the second storage part includes first and second spaces that are separated by a second sidewall.

14. A detergent supplier for a laundry treating apparatus, the detergent supplier comprising:

a storage body having a first storage part configured to hold a first detergent, the first storage part being configured to communicate with a laundry receiving part, and a second storage part configured to hold a second detergent, wherein the second detergent is in liquid form, a passage body having a water supply passage configured to supply wash water to the first storage part, and a liquid detergent supply part configured to supply the second detergent in the second storage part to the water supply passage, wherein the liquid detergent supply part comprises:

a pump configured to discharge the second detergent from the second storage part, and a supply pipe configured to supply the second detergent discharged from the pump to the water supply passage.

15. The detergent supplier of claim 14, further comprising:

a cover provided above the passage body, the cover being configured to seal the water supply passage, wherein the cover includes a cover perforating hole that perforates the cover, the cover perforating hole being configured to enable fluidic communication between the water supply passage and the supply pipe.

16. The detergent supplier of claim 15, wherein the liquid detergent supply part further comprises a valve body, the valve body including a body perforating hole that enables fluidic communication with the cover perforating hole, and wherein the supply pipe is configured to lead the second detergent to the body perforating hole.

17. The detergent supplier of claim 16, wherein the liquid detergent supply part further comprises a valve configured to selectively open and close the body perforating hole.

18. The detergent supplier of claim 16, wherein the cover further comprises a flange that is configured to surround the cover perforating hole and to seat the valve body within the flange, the flange including one or more ribs that extend inward toward the valve body, and wherein the liquid detergent supply part further comprises a ball that is configured to be supported by the one or more ribs, the ball being configured to allow fluid flow from the body perforating hole into the cover perforating hole and to prevent the wash water from flowing from the cover perforating hole into the body perforating hole.

19. The detergent supplier of claim 14, wherein the first storage part is configured to hold the first detergent, wherein the first detergent includes detergent that is in powder form.

20. The detergent supplier of claim 14, wherein the first storage part includes first and second spaces that are separated by a first sidewall, and wherein the second storage part includes first and second spaces that are separated by a second sidewall.

* * * * *